US010695810B2

(12) United States Patent
Lu et al.

(10) Patent No.: US 10,695,810 B2
(45) Date of Patent: Jun. 30, 2020

(54) DESCALING SYSTEM, CONTROL DEVICE OF THE DESCALING SYSTEM, AND METHOD FOR CONTROLLING THE DESCALING SYSTEM

(71) Applicant: TOSHIBA MITSUBISHI-ELECTRIC INDUSTRIAL SYSTEMS CORPORATION, Chuo-ku (JP)

(72) Inventors: Zijun Lu, Chuo (JP); Kei Kubota, Chuo (JP)

(73) Assignee: TOSHIBA MITSUBISHI-ELECTRIC INDUSTRIAL SYSTEMS CORPORATION, Tokyo (JP)

( * ) Notice: Subject to any disclaimer, the term of this patent is extended or adjusted under 35 U.S.C. 154(b) by 413 days.

(21) Appl. No.: 15/549,574

(22) PCT Filed: Feb. 9, 2015

(86) PCT No.: PCT/JP2015/053530
§ 371 (c)(1),
(2) Date: Aug. 8, 2017

(87) PCT Pub. No.: WO2016/129040
PCT Pub. Date: Aug. 18, 2016

(65) Prior Publication Data
US 2018/0021825 A1 Jan. 25, 2018

(51) Int. Cl.
*B21B 45/08* (2006.01)
*B21B 45/02* (2006.01)

(52) U.S. Cl.
CPC ..... *B21B 45/08* (2013.01); *B21B 45/0218* (2013.01)

(58) Field of Classification Search
CPC ..... B21B 37/44; B21B 37/76; B21B 45/0218; B21B 45/0233; B21B 45/04; B21B 45/06; B21B 45/08
See application file for complete search history.

(56) References Cited

U.S. PATENT DOCUMENTS 3,779,054 A * 12/1973 Greenberger ..... B21B 37/74 72/12.2
4,132,393 A * 1/1979 Nakamura ..... B21B 45/0218 266/113

(Continued)

FOREIGN PATENT DOCUMENTS

JP 56-53815 A * 5/1981 ..... B21B 37/76
JP 1-178305 A * 7/1989 ..... B21B 45/0233

(Continued)

OTHER PUBLICATIONS

Translation; JP56-53815A, May 1981.*
International Search Report dated Mar. 31, 2015 in PCT/JP2015/053530 filed Feb. 9, 2015.

*Primary Examiner* — Edward T Tolan
(74) *Attorney, Agent, or Firm* — Xsensus LLP

(57) ABSTRACT

According to an embodiment of the invention, a descaling system is provided that includes multiple descaling headers, a common pipe, a connection pipe, a pump, a drive device, a branch pipe, a valve, and a control device. The multiple descaling headers are provided in a rolling line. The common pipe is connected to each of the multiple descaling headers. The connection pipe is connected to the common pipe. The pump is connected to the connection pipe and supplies high pressure water to each of the multiple descaling headers via the connection pipe and the common pipe. The drive device controls the driving of the pump. The branch pipe is connected to the connection pipe. The valve is provided in the branch pipe and controls the opening/closing of the branch pipe. The control device includes a data collector, a pressure calculator, a pump controller, and a protector. The data collector collects common pipe pressure information indicating the pressure inside the common pipe, rolling material position information indicating the position on the rolling line of a rolling material, and rolling material property information indicating a material property of the rolling material. The pressure calculator calculates the pressure inside the common pipe to satisfy the desired scale removal performance for the rolling material based on the common pipe pressure information, the rolling material (Continued)

position information, and the rolling material property information. The pump controller calculates the operation pattern of the pump to maintain the calculated pressure inside the common pipe and inputs the operation pattern to the drive device. The protector calculates the operation amount of the valve based on the operation pattern and controls the opening/closing of the valve according to the operation amount. Thus, a descaling system, a control device of the descaling system, and a method for controlling the descaling system are provided, in which higher energy conservation is realized and the descaling system has a long life while maintaining the scale removal performance of the descaling system.

9 Claims, 5 Drawing Sheets

(56) References Cited

U.S. PATENT DOCUMENTS

| | | | | |
|---|---|---|---|---|
| 4,371,149 | A * | 2/1983 | Takeuchi | C21D 1/667 266/113 |
| 5,235,840 | A * | 8/1993 | Blazevic | B21B 37/74 72/201 |
| 5,502,881 | A * | 4/1996 | Gaydoul | B05B 3/027 29/81.08 |
| 5,661,884 | A * | 9/1997 | Thomas | B08B 3/022 29/81.01 |
| 7,181,943 | B2 * | 2/2007 | Seidel | B21B 37/74 72/236 |
| 8,950,227 | B2 * | 2/2015 | Hohenbichler | B21B 37/74 72/12.2 |
| 2016/0107214 | A1 * | 4/2016 | Clark | B21B 45/08 72/12.7 |

FOREIGN PATENT DOCUMENTS

| | | | |
|---|---|---|---|
| JP | 11-104729 | A | 4/1999 |
| JP | 11-156426 | A | 6/1999 |
| JP | 2000-288620 | A | 10/2000 |
| JP | I241154 | B | 10/2005 |
| JP | 2013-158832 | A | 8/2013 |
| TW | 201313351 | A | 4/2013 |

* cited by examiner

DESCALING SYSTEM, CONTROL DEVICE OF THE DESCALING SYSTEM, AND METHOD FOR CONTROLLING THE DESCALING SYSTEM

FIELD

Embodiments described herein relate generally to a descaling system, a control device of the descaling system, and a method for controlling the descaling system.

BACKGROUND ART

In the hot rolling of steel, for example, scale, i.e., an oxide film, is formed on the surface of the rolling material when rolling. If the rolling is performed while the scale is adhered to the surface, good surface properties of the rolling material cannot be maintained. Therefore, the removal of the scale is performed by a descaling system by spraying high pressure water onto the surface of the rolling material.

The descaling system includes, for example, multiple descaling headers spraying the high pressure water toward the rolling material, a pump supplying the high pressure water to the descaling headers, an electric motor driving the pump, and a valve. For example, the valve controls the opening/closing of a branch pipe for releasing the water supplied from the pump into a pit, etc., in the state in which the water is not sprayed from the descaling headers, etc.

Also, in the descaling system, multiple pumps and electric motors of the same rating are arranged in parallel; and the high pressure water is supplied to the descaling headers from the multiple pumps. For example, in the case where multiple pumps and/or electric motors of different ratings are used, the pressures at the output ends of the pumps are undesirably different. Also, if the pumps are connected in series, water of a constant pressure unfortunately can no longer be supplied because the pressure supplied is different due to the number of operating pumps.

If the operations of the electric motor and the pump are stopped undesirably in the state in which the water is not sprayed from the descaling headers, there is a risk that the necessary pressure cannot be obtained when performing the next spraying. Therefore, there is a descaling system in which the operations of the multiple pumps are continued at a constant rotation speed. In such a case, in the state in which the descaling headers are not spraying, the high pressure water is merely released to the branch pipe side by opening the valves to protect the pumps and/or the electric motors; and energy is undesirably consumed wastefully. It is necessary for the water sprayed from the descaling headers to have a high pressure; and it is necessary for the electric motors and/or the pumps to have a large capacity. Therefore, it is desirable to suppress the wasteful consumption of energy such as that recited above as much as possible.

For example, in Patent Document 1, the necessary water amount is predicted from the position information of the rolling material and the spray patterns of the descaling headers; the number of operating pumps is calculated based on the predicted water amount; and the operations of the pumps are controlled. From the calculation result, the pumps other than the necessary number of pumps are caused to standby at the standby speed until the next acceleration timing. Due to mechanical constraints, a constant amount of time is necessary until the pump switches from the standby operation to the high-speed operation. Therefore, the high-speed operation of the pump is started prior to the timing of the actual spraying by the amount of time necessary to reach the high-speed operation. Thereby, it is possible to operate the pumps at the necessary time and at the necessary rotation speed; and higher energy conservation of the descaling system is possible.

CITATION LIST

Patent Literature

[PTL 1]
JP-A 2000-288620 (Kokai)
[PTL 2]
JP-A 2013-158832 (Kokai)

SUMMARY OF INVENTION

Technical Problem

In the case where one or more pumps are operated at full speed and the other pumps are in the standby operation, the high water pressure in the common pipe is maintained by the output water pressures of the pumps operated at full speed and by an accumulator connected to the common pipe. This water pressure is higher than the water pressure dispensed by the pumps in the standby operation; and an unbalance of the pressure undesirably occurs in the common pipe. For example, the pumps in the standby operation undesirably have reverse rotation due to the water pressure from the common pipe.

Although check valves can be provided in the pipes on the pump outlet side and the reverse rotation of the pumps in the standby operation also can be suppressed by stopping the water pressure of the common pipe by the action of the check valves, in such a case, the pumps in the standby operation are undesirably in the shutoff operation state. In the shutoff operation, there is a risk that the liquid temperature inside the pump may abruptly increase in a short period of time; the pump casing, etc., may break; and the handled liquid may be emitted to the atmosphere. Therefore, it is necessary to avoid the shutoff operation.

Further, in the shutoff operation state, there are cases where the pump causes vibrations if the pump is caused to accelerate in a short period of time, if the pressure is increased by feeding the high pressure water from the pump into the common pipe, or if the pressure is reduced by setting the pump to the standby operation. In such cases, there is a risk that the equipment life may be shorter for the pumps, the pipes, etc.

Even if the consumed energy is reduced, resources are wasted if repairs and replacement of the equipment occur frequently; and for safety as well, accidents due to equipment failure, etc., also may occur.

Therefore, in a descaling system, a control device of the descaling system, and a method for controlling the descaling system, it is desirable to realize higher energy conservation and reduce the effects on the life of the descaling system while maintaining the scale removal performance of the descaling system for each of the materials.

Solution to Problem

According to an embodiment of the invention, a descaling system is provided that includes multiple descaling headers, a common pipe, a connection pipe, a pump, a drive device, a branch pipe, a valve, and a control device. The multiple descaling headers are provided in a rolling line. The common pipe is connected to each of the multiple descaling headers. The connection pipe is connected to the common pipe. The pump is connected to the connection pipe and supplies high pressure water to each of the multiple descaling headers via the connection pipe and the common pipe. The drive device controls the driving of the pump. The branch pipe is connected to the connection pipe. The valve is provided in the branch pipe and controls the opening/closing of the branch pipe. The control device includes a data collector, a pressure calculator, a pump controller, and a protector. The data collector collects common pipe pressure information indicating the pressure inside the common pipe, rolling material position information indicating the position on the rolling line of a rolling material, and rolling material property information indicating a material property of the rolling material. The pressure calculator calculates the pressure inside the common pipe to satisfy the desired scale removal performance for the rolling material based on the common pipe pressure information, the rolling material position information, and the rolling material property information. The pump controller calculates the operation pattern of the pump to maintain the calculated pressure inside the common pipe and inputs the operation pattern to the drive device. The protector calculates the operation amount of the valve based on the operation pattern and controls the opening/closing of the valve according to the operation amount.

Advantageous Effects of Invention

According to embodiments of the invention, a descaling system, a control device of the descaling system, and a method for controlling the descaling system are provided, in which higher energy conservation is realized and the descaling system has a long life while maintaining the scale removal performance of the descaling system for each of the materials.

DESCRIPTION OF EMBODIMENTS

Figure 1:
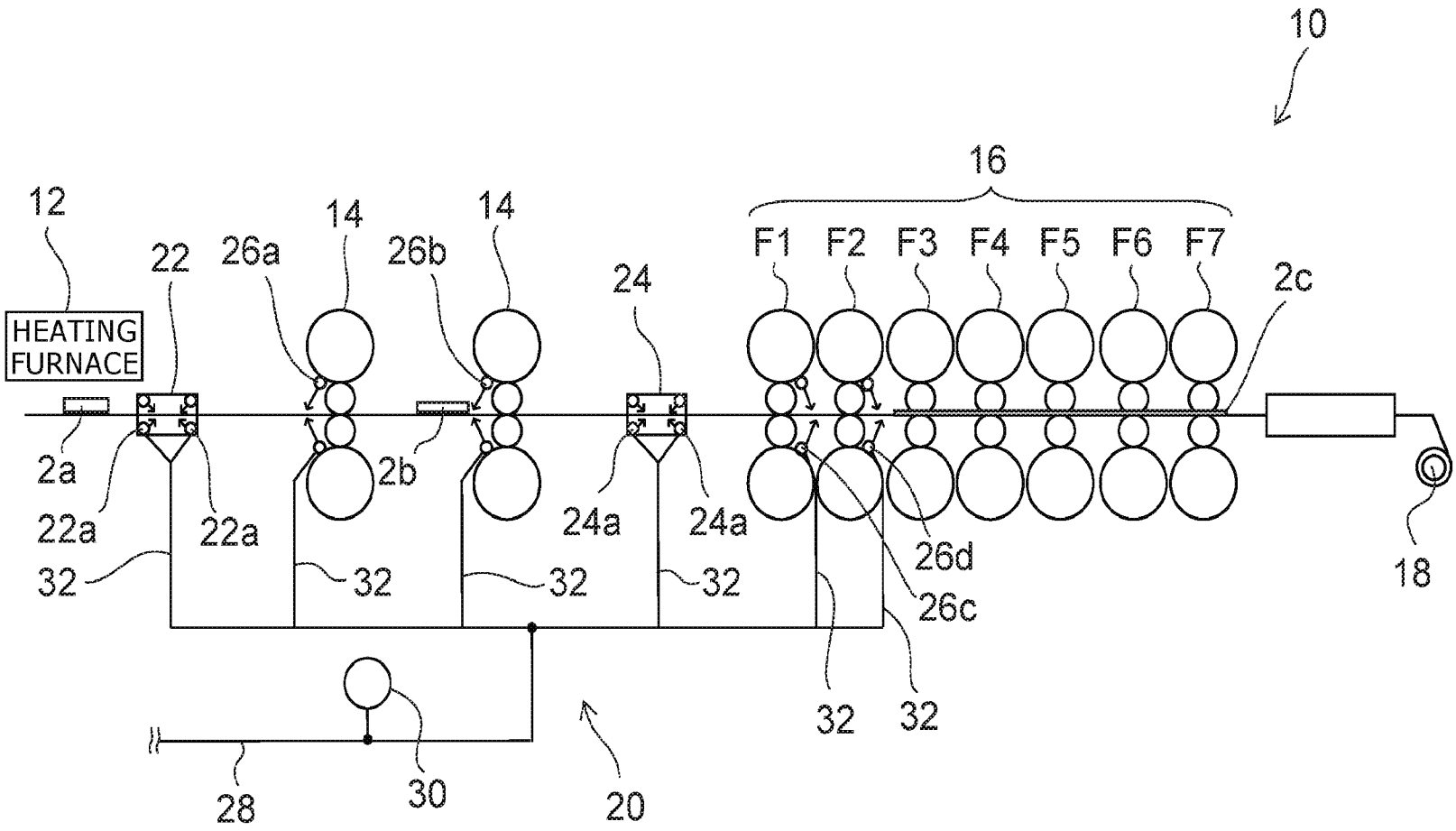
FIG. 1 is a schematic view illustrating an example of a rolling line according to an embodiment.

Various embodiments will be described hereinafter with reference to the accompanying drawings.

The drawings are schematic or conceptual. The relationship between the thickness and the width of each portion, and the size ratio between the portions, for instance, are not necessarily identical to those in reality. Furthermore, the same portion may be shown with different dimensions or ratios depending on the figures.

In the present specification and the drawings, components similar to those described previously with reference to earlier figures are labeled with like reference numerals, and the detailed description thereof is omitted appropriately.

FIG. 1 is a schematic view illustrating an example of a rolling line according to an embodiment.

As illustrated in FIG. 1, a rolling line 10 includes a heating furnace 12, a rough rolling mill 14, a finishing rolling mill 16, a coiler 18, and a descaling system 20. The rolling line 10 is a line performing hot rolling.

The heating furnace 12 heats a rolling material 2*a* (a slab) manufactured in an upstream process to a temperature necessary for hot rolling. For example, the heating furnace 12 heats the rolling material 2*a* to a temperature of about 1200° C.

The rough rolling mill 14 forms an intermediate material 2*b* (a rough bar) from the rolling material 2*a* by rolling the rolling material 2*a* to a prescribed sheet thickness and sheet width. The rough rolling mill 14 includes, for example, a reversing rolling mill. In the example, two rough rolling mills 14 that are arranged in the feed direction of the rolling material 2*a* (the intermediate material 2*b*) are provided in the rolling line 10. The number of the rough rolling mills 14 is not limited to two and may be one or may be three or more.

The finishing rolling mill 16 forms a hot-rolled steel sheet 2*c* from the intermediate material 2*b* by further rolling the intermediate material 2*b*. The finishing rolling mill 16 includes, for example, a tandem rolling mill in which multiple finishing stands F1 to F7 are arranged in the feed direction. Seven finishing stands F1 to F7 are provided in the example. The number of finishing stands is not limited to seven and may be any number.

The coiler 18 winds the hot-rolled steel sheet 2*c* formed by the finishing rolling mill 16 into a coil shape. The coiler 18 forms a so-called rolled coil.

The descaling system 20 includes a water-pressure scale breaker (HSB: Hot Scale Breaker) 22, a finish scale breaker (FSB: Finish Scale Breaker) 24, multiple descaling headers 26*a* to 26*d*, a common pipe 28, a pressure gauge 30, and multiple individual pipes 32.

The HSB 22 is disposed on the outlet side of the heating furnace 12. In other words, the HSB 22 is disposed between the heating furnace 12 and the first rough rolling mill 14. The multiple descaling headers 22*a* are provided in the HSB 22. The HSB 22 removes foreign matters such as scale, etc., adhered to the surface of the rolling material 2*a* by spraying high pressure water from each of the descaling headers 22*a* toward the rolling material 2*a*. The scale is, for example, an oxide film.

The FSB 24 is disposed on the inlet side of the finishing rolling mill 16. In other words, the FSB 24 is disposed between the finishing rolling mill 16 and the final rough rolling mill 14 (in the example, the second rough rolling mill 14). Multiple descaling headers 24*a* are provided in the FSB 24. The FSB 24 removes the scale adhered to the surface of the intermediate material 2*b* by spraying the high pressure water from each of the descaling headers 24*a* toward the intermediate material 2*b*.

The descaling header 26*a* is provided on the inlet side of the first rough rolling mill 14. The descaling header 26*b* is provided on the inlet side of the second rough rolling mill 14. The descaling headers 26*a* and 26*b* remove the scale adhered to the surface of the rolling material 2*a* by spraying high pressure water toward the rolling material 2*a*. Thus, in the case where the multiple rough rolling mills 14 are provided, a descaling header is provided at each of the rough rolling mills 14.

The descaling headers 26*c* and 26*d* are provided between the upstream stands of the finishing rolling mill 16. For example, the descaling header 26*c* is provided between the first finishing stand F1 and the second finishing stand F2. The descaling header 26*d* is provided between the second finishing stand F2 and the third finishing stand F3. The descaling headers 26*c* and 26*d* remove the scale adhered to the surface of the intermediate material 2*b* by spraying high pressure water toward the intermediate material 2*b*.

Thus, the descaling system 20 removes the scale of the rolling material 2*a* discharged from the heating furnace 12 by using the HSB 22, removes the scale of the rolling material 2*a* by using the descaling headers 26*a* and 26*b* prior to rolling the rolling material 2*a* by the rough rolling mills 14, and removes the scale of the intermediate material 2*b* by using the descaling headers 26*c* and 26*d* when rolling the intermediate material 2*b* by the finishing rolling mill 16. The arrangement and numbers of the HSB 22, the FSB 24, and the descaling headers 22*a*, 24*a*, and 26*a* to 26*d* are not limited to those recited above and may be arbitrary.

In the descaling system 20, for example, a sensor (not illustrated) that detects the rolling material 2*a* is provided directly in front of, for example, each of the descaling headers 22*a*, 24*a*, and 26*a* to 26*d*. The descaling headers 22*a*, 24*a*, and 26*a* to 26*d* spray the high pressure water according to the detection of the sensors.

The common pipe 28 is connected to each of the descaling headers 22*a*, 24*a*, and 26*a* to 26*d*. The common pipe 28 supplies the high pressure water to each of the descaling headers 22*a*, 24*a*, and 26*a* to 26*d*. The pressure gauge 30 measures the pressure inside the common pipe 28. The pressure value of the common pipe 28 is an indicator indicating the desired scale removal performance of the descaling system 20.

The individual pipes 32 are provided respectively between the common pipe 28 and the descaling headers 22*a*, 24*a*, and 26*a* to 26*d*. The descaling headers 22*a*, 24*a*, and 26*a* to 26*d* are connected to the common pipe 28 respectively via the individual pipes 32.

Figure 2:
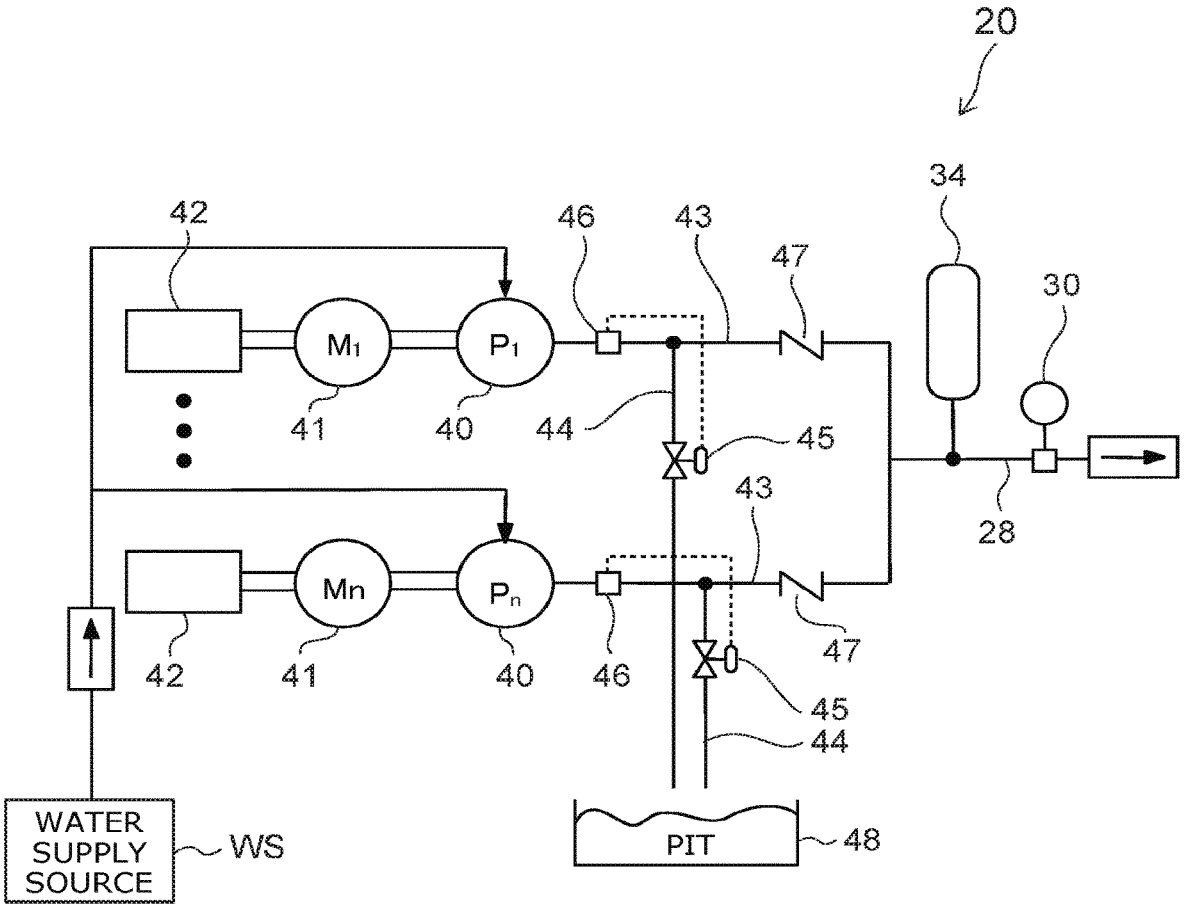
FIG. 2 is a block diagram schematically illustrating an example of the descaling system according to the embodiment.

FIG. 2 is a block diagram schematically illustrating an example of the descaling system according to the embodiment.

As illustrated in FIG. 2, the descaling system 20 further includes a pump 40, an electric motor 41, a drive device 42, a connection pipe 43, a branch pipe 44, a valve 45, a pressure gauge 46, and a check valve 47. Arrows on the pipe path in the drawing illustrate the direction in which the water flows.

The pump 40 is provided between a water supply source WS and the common pipe 28. Also, the pump 40 is connected to the electric motor 41. The electric motor 41 supplies a drive force to the pump 40. The pump 40 is driven according to the supply of the drive force from the electric motor 41 and supplies the water of the water supply source WS to the common pipe 28 by providing a prescribed pressure and flow rate to the water. In other words, the pump 40 supplies the high pressure water to each of the descaling headers 22*a*, 24*a*, and 26*a* to 26*d* via the common pipe 28.

The pump 40 includes, for example, a centrifugal pump. The electric motor 41 supplies the drive force to the pump 40 by rotating the impeller of the pump 40 and drives the pump 40 by rotating the impeller. The supply of the drive force to the pump 40 is not limited to the electric motor 41 and, for example, another power source such as a hydraulic actuator, etc., may be used. It is sufficient to select the power source according to the type of the pump 40. Also, the power source may be included inside the pump 40.

The electric motor 41 is electrically connected to the drive device 42. The drive device 42 controls the operation of the electric motor 41. For example, the drive device 42 controls the rotation speed of the electric motor 41 by the voltage applied to the electric motor 41. Thereby, the drive device 42 controls the driving of the pump 40. In other words, the drive device 42 controls the pressure of the high pressure water supplied to each of the descaling headers 22*a*, 24*a*, and 26*a* to 26*d*. The drive device 42 includes, for example, an inverter circuit.

The connection pipe 43 is provided between the pump 40 and the common pipe 28. The connection pipe 43 is connected to the pump 40 and the common pipe 28. The connection pipe 43 feeds the high pressure water supplied from the pump 40 to the common pipe 28 and to each of the descaling headers 22*a*, 24*a*, and 26*a* to 26*d*. In other words, the pump 40 supplies the high pressure water to each of the descaling headers 22*a*, 24*a*, and 26*a* to 26*d* via the connection pipe 43 and the common pipe 28.

The branch pipe 44 is connected to the connection pipe 43. The valve 45 is provided on the pipe path of the branch pipe 44. The valve 45 controls the opening/closing of the branch pipe 44. Thereby, when the valve 45 is closed, the high pressure water that is supplied from the pump 40 is supplied to the common pipe 28 via the connection pipe 43. On the other hand, when the valve 45 is opened, the high pressure water that is supplied from the pump 40 is discharged outside via the branch pipe 44. For example, the water that is supplied from the pump 40 is discharged into a pit 48 via the branch pipe 44. Thus, the valve 45 switches between supplying the high pressure water to the common pipe 28 side and discharging the high pressure water. The valve 45 includes, for example, a relief valve, a minimum flow valve, etc.

The pressure gauge 46 measures the pressure on the dispensing side of the pump 40. In other words, the pressure gauge 46 measures the pressure inside the connection pipe 43. For example, the opening/closing of the valve 45 is controlled by the pressure value on the dispensing side of the pump 40 measured by the pressure gauge 46. For example, when a pressure not less than a constant value is measured when each of the descaling headers 22*a*, 24*a*, and 26*a* to 26*d* on the rolling line is unused, etc., the valve 45 is opened; and the high pressure water is released into the branch pipe 44.

The check valve 47 is provided on the pipe path of the connection pipe 43. In other words, the check valve 47 is provided on the dispensing side of the pump 40. For example, the check valve 47 is provided in the portion between the common pipe 28 and the branch pipe 44 of the connection pipe 43. The check valve 47 suppresses the reverse flow of the high pressure water. The check valve 47 suppresses the flow of the water from the common pipe 28 side toward the pump 40.

The pump 40, the electric motor 41, the drive device 42, the connection pipe 43, the branch pipe 44, the valve 45, the pressure gauge 46, and the check valve 47 each are multiply provided in the descaling system 20. In the descaling system 20, the pressure of the high pressure water is controlled by driving the multiple pumps 40. Also, in the descaling system 20, higher energy conservation is realized by controlling the operations of the pumps 40 and the electric motors 41 according to the necessary pressure. It is sufficient to arbitrarily set the number of the pumps 40 and the like provided in the descaling system 20 according to the necessary pressure. For example, the number of the pumps 40 and the like provided in the descaling system 20 may be one each. Higher energy conservation may be realized by switching the high-speed operation and the standby operation of one pump 40.

The multiple connection pipes 43 are connected in parallel with the common pipe 28. The multiple pumps 40 are connected respectively to the multiple connection pipes 43. The multiple drive devices 42 respectively control the driving of the multiple pumps 40. The multiple branch pipes 44 are connected respectively to the multiple connection pipes 43. The multiple valves 45 are provided respectively in the multiple branch pipes 44 and respectively control the opening/closing of the multiple branch pipes 44.

For example, pumps that have the same rating are used as the multiple pumps 40. Similarly, for example, electric motors that have the same rating are used as the multiple electric motors 41. Thereby, for example, the fluctuation of the pressure of the water supplied from each of the pumps 40 is suppressed. Also, the multiple pumps 40, the multiple electric motors 41, etc., are connected in parallel with the common pipe 28. Thereby, compared to the case of being connected in series, the pressure of the common pipe 28 is easier to control.

The descaling system 20 further includes an accumulator 34. The accumulator 34 is provided on the pipe path of the common pipe 28. For example, the accumulator 34 is provided between each of the descaling headers 22*a*, 24*a*, and 26*a* to 26*d* and each of the check valves 47. The accumulator 34 suppresses pressure pulsation of the water inside the common pipe 28. A large-capacity accumulator 34 is provided in the descaling system 20. Thereby, for example, even when the supply of the high pressure water from the pumps 40 is insufficient due to the spraying of the water from the descaling headers 22*a*, 24*a*, and 26*a* to 26*d*, a temporary decrease of the pressure and/or decrease of the water amount can be compensated by discharging the high pressure water from the accumulator 34.

Figure 3:
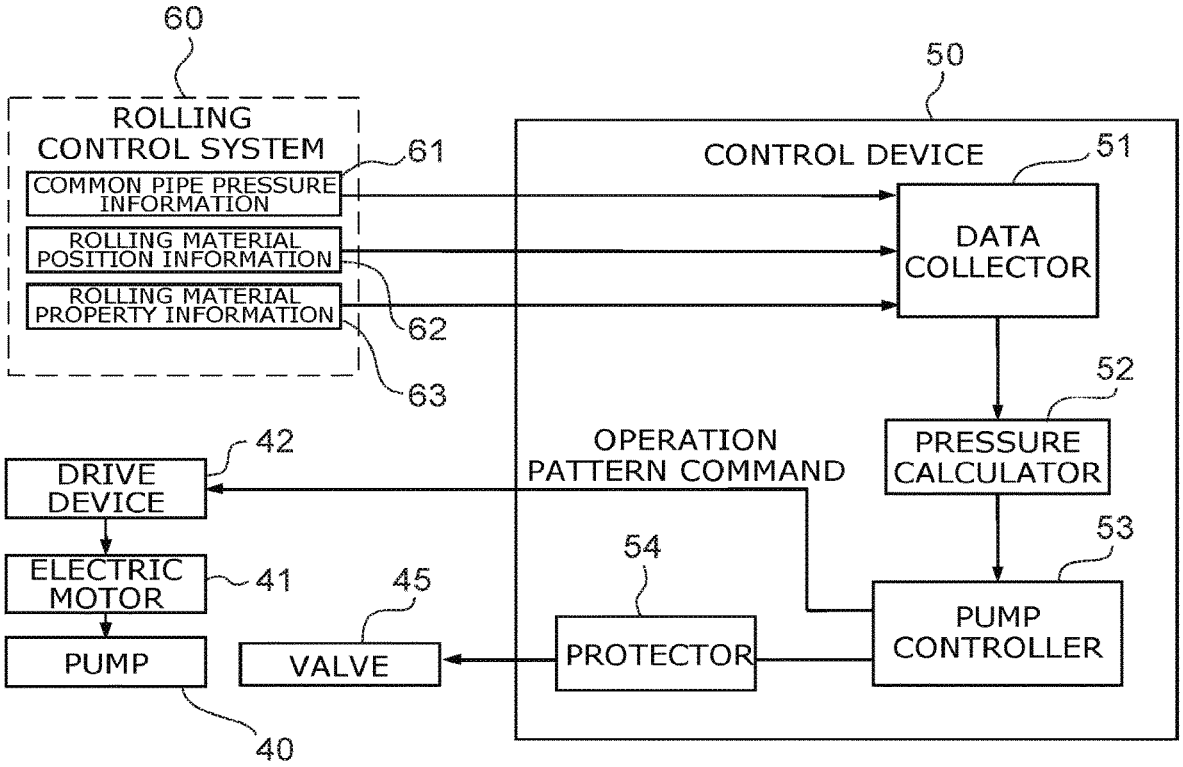
FIG. 3 is a block diagram schematically illustrating an example of the descaling system according to the embodiment.

FIG. 3 is a block diagram schematically illustrating an example of the descaling system according to the embodiment.

As illustrated in FIG. 3, the descaling system 20 further includes a control device 50. The control device 50 includes a data collector 51, a pressure calculator 52, a pump controller 53, and a protector 54. The components of the data collector 51, the pressure calculator 52, the pump controller 53, and the protector 54 may be provided inside one apparatus or may be provided as independent apparatuses.

The data collector 51 collects and stores data from a rolling control system 60 of the rolling line 10. The rolling control system 60 is, for example, a higher-level system controlling the rolling of the rolling material 2*a* of the rolling line 10. In the example, the data collector 51 collects common pipe pressure information 61, rolling material position information 62, and rolling material property information 63.

The common pipe pressure information 61 indicates the pressure inside the common pipe 28. The common pipe pressure information 61 is measured by the pressure gauge 30 of the common pipe 28 and is input to the data collector 51. The rolling material position information 62 is information indicating the position on the rolling line 10 of the rolling material 2*a*. For example, the location of the extraction from the heating furnace 12 is used as the starting point of the rolling material position information 62. The rolling material property information 63 indicates the material properties of the rolling material 2*a*. For example, the rolling material property information 63 indicates the physical properties such as the surface, the strength, etc., of each of the rolling materials 2*a* as final products. The material properties of the rolling material 2*a* are already determined prior to the rolling of the rolling material 2*a*.

The pressure calculator 52 calculates the pressure of the common pipe 28 to satisfy the desired scale removal performance for each of the rolling materials 2*a* based on the common pipe pressure information 61, the rolling material position information 62, and the rolling material property information 63 that are collected.

In the rolling line 10, for example, the rolling is performed for the rolling materials 2*a* of different materials such as iron, stainless steel, etc. In the case where the material properties of the rolling materials 2*a* are different, for example, the number of reverse rolling, the feed speed when rolling, etc., of the rough rolling mills 14 are different. Further, the number of the descaling headers 22*a* used in the HSB 22 and the number of the descaling headers 24*a* used in the FSB 24 are different between the rolling materials 2*a*. In other words, the spray patterns of the high pressure water for the descaling headers 22*a*, 24*a*, and 26*a* to 26*d* are different according to the material properties of the rolling materials 2*a*. Therefore, the pressure calculator 52 designates the spray patterns of the high pressure water for the descaling headers 22*a*, 24*a*, and 26*a* to 26*d* based on the rolling material property information 63. Also, for example, the pressure calculator 52 designates the position of the rolling material 2*a* based on the rolling material position information 62 and predicts the spray timing of each of the descaling headers 22*a*, 24*a*, and 26*a* to 26*d* from the position of the rolling material 2*a* and the designated spray patterns. The pressure calculator 52 calculates the necessary pressure inside the common pipe 28 from the spray timing. Also, the pressure calculator 52 acquires the current pressure inside the common pipe 28 based on the common pipe pressure information 61.

Thereby, the pressure calculator 52 calculates the pressure of the common pipe 28 based on the common pipe pressure information 61, the rolling material position information 62, and the rolling material property information 63.

The pump controller 53 calculates the operation pattern of the pump 40 that can maintain the pressure of the common pipe 28 calculated by the pressure calculator 52. Then, the pump controller 53 provides the calculated operation pattern to the drive device 42 of the descaling system 20 as an operation pattern command of the pump 40. Also, the pump operation patterns are the combination of the pumps 40 of the multiple pumps 40 operatable at the standby speed and the pumps 40 of the multiple pumps 40 for which high-speed operation is necessary. For example, the operation patterns indicate the timing of setting the pumps 40 to the high-speed operation and the timing of setting the pumps 40 to the standby operation.

The pump controller 53 calculates the operation pattern of each of the multiple pumps 40 and inputs the calculation result to the drive devices 42 respectively corresponding to the pumps 40. Each of the drive devices 42 controls the operation of the electric motor 41 according to the operation pattern that is input. For example, each of the drive devices 42 switches between the high-speed operation and the standby operation of the pump 40 according to the operation pattern.

Here, the high-speed operation is, for example, an operation of rotating the electric motor 41 (the pump 40) at the rotational speed of the rated operation. The standby operation is, for example, the operation of rotating the electric motor 41 at a rotational speed of about 50% in the case where the rotational speed of the rated operation of the electric motor 41 is set to 100%. The high-speed operation is, for example, the operation of setting the drive amount of the pump 40 to a first value. The standby operation is, for example, an operation of setting the drive amount of the pump 40 to a second value that is less than the first value.

The first value is, for example, the drive amount of 100%. The second value is, for example, the drive amount of 50%. The drive amount of the pump 40 is, for example, the rotational speed of the pump 40. It is sufficient for the drive amount of the pump 40 to be determined according to the type of the pump 40.

If the operation of the pump 40 is completely stopped, time is necessary to restore the high-speed operation; and there is a possibility that the necessary pressure unfortunately may not be obtained when spraying the high pressure water from the descaling header. Therefore, in the standby operation as well, the pump 40 and the electric motor 41 are operated in advance at some rotational speed. When switching from the standby operation to the high-speed operation, the time to reach the high-speed operation is calculated; and the operation of the electric motor 41 is switched sooner than the timing of actually performing the spraying by the amount of that time. Thereby, the spraying of the high pressure water at the desired pressure can be performed while realizing higher energy conservation.

The rotational speed of the electric motor 41 of the standby operation may be any rotational speed for which the pressure necessary when spraying the high pressure water is obtained. For example, the rotational speed of the electric motor 41 of the standby operation may be set arbitrarily from multiple types such as 85%, 70%, 55%, etc. Further, the rotational speed of the electric motor 41 of the standby operation may be changed arbitrarily according to the necessary pressure of the high pressure water.

The protector 54 is electrically connected to the pump controller 53 and each of the valves 45. The pump controller 53 inputs the calculated operation patterns of the pumps 54 respectively to the drive devices 42 and inputs the operation patterns to the protector 54.

The protector 54 calculates, from the operation pattern commands, the operation amounts of the valves 45 mounted between the common pipe 28 and the pumps 40. The protector 54 calculates the operation amounts of the valves 45 from the operation patterns. The protector 54 inputs the calculated operation amounts respectively to the valves 45 and controls the opening/closing of the valves 45.

The protector 54 closes the valves 45 corresponding to the pumps 40 set to the high-speed operation and opens the valves 45 corresponding to the pumps 40 set to the standby operation.

For example, the protector 54 closes the valve 45 when the drive amount of the pump 40 is the first value and opens the valve 45 when the drive amount of the pump 40 is the second value. In other words, the protector 54 closes the valve 45 when the drive amount of the pump 40 is the first value and opens the valve 45 when the drive amount of the pump 40 is less than the first value. Thereby, in the control device 50, the protector 54 protects the pumps 40 and the pipes (the connection pipe 43, the branch pipe 44, etc.) around the pumps 40 included in the descaling system 20.

When the rotational speed of the electric motor 41 is changed in the standby operation, the opening amount of the valve 45 may be changed according to the rotational speed of the electric motor 41. For example, in the case where the rotational speed of the electric motor 41 is relatively high, the opening amount of the valve 45 may be set to be large; and in the case where the rotational speed of the electric motor 41 is relatively low, the opening amount of the valve 45 may be set to be small.

Functions of the control device 50 according to the embodiment will now be described.

Figure 4:
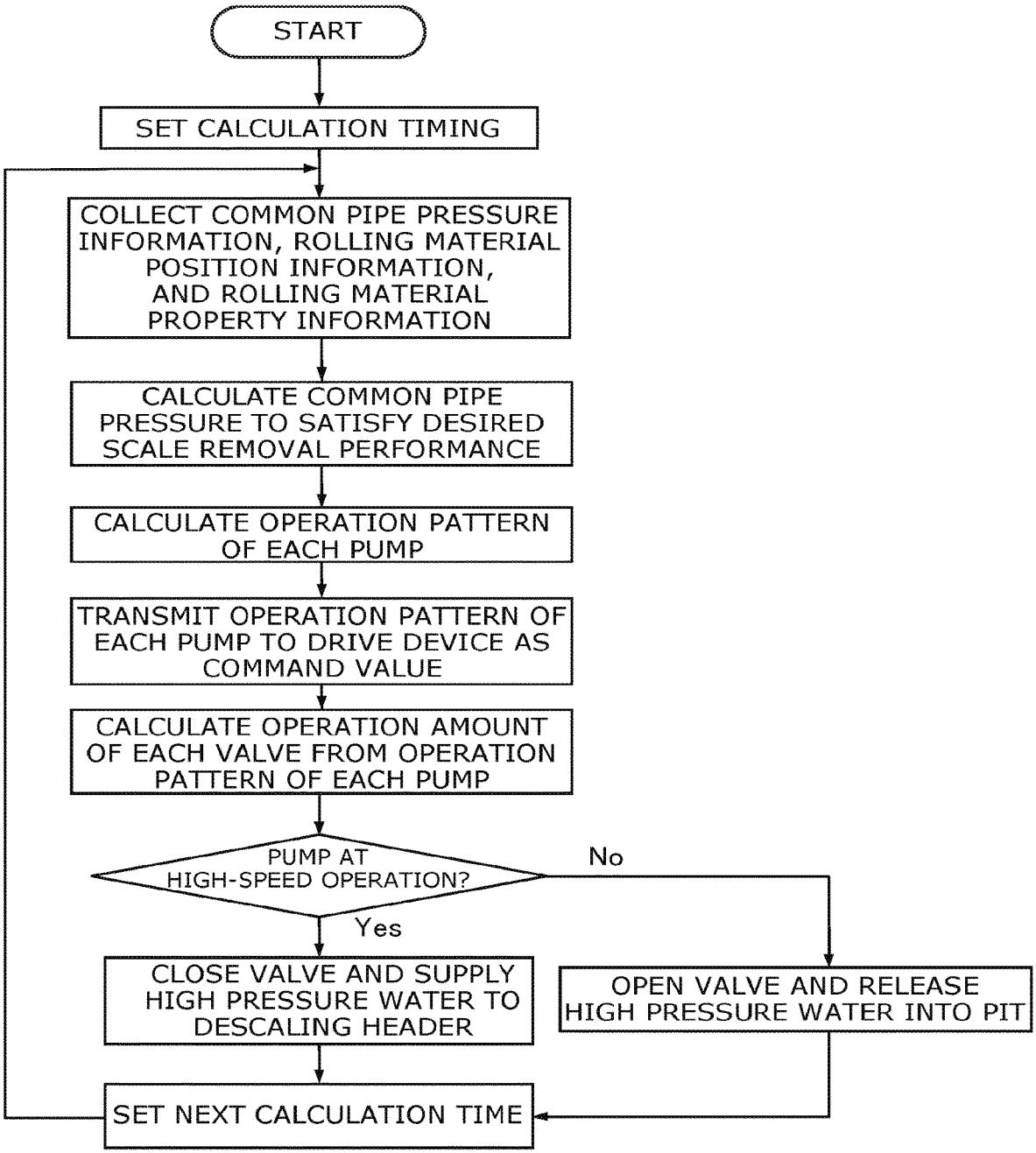
FIG. 4 is a flowchart schematically illustrating an example of the process flow of the control device according to the embodiment.

FIG. 4 is a flowchart schematically illustrating an example of the process flow of the control device according to the embodiment.

Figure 5:
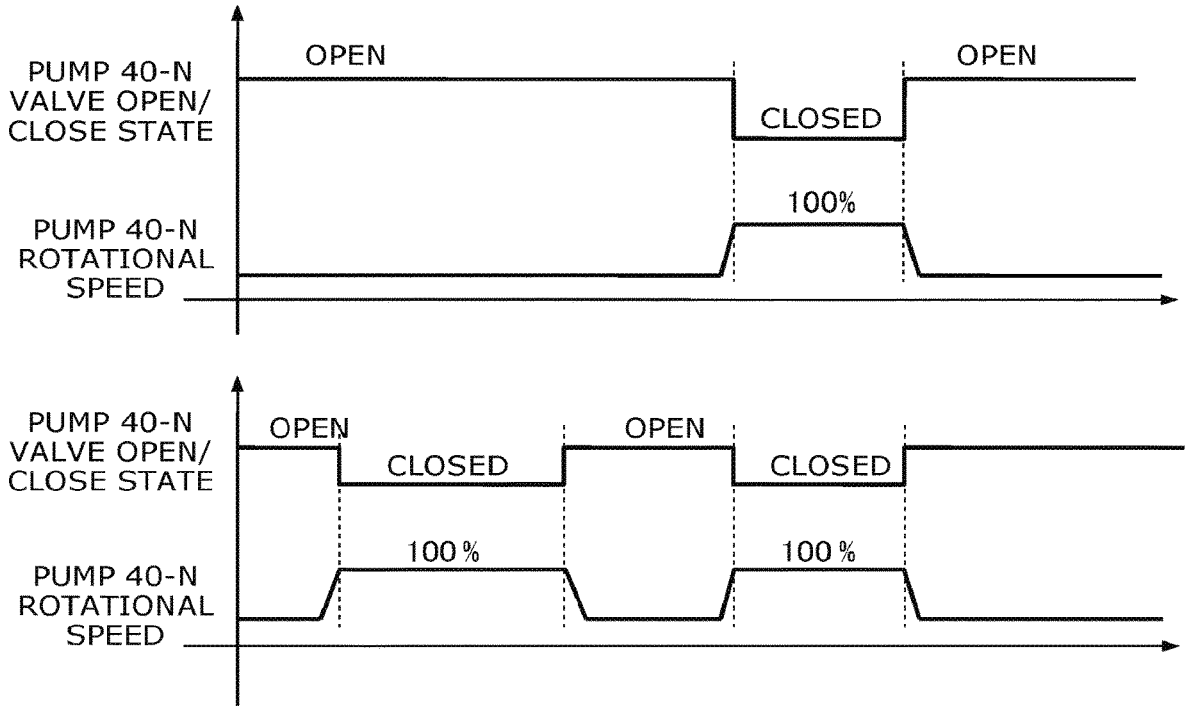
FIG. 5 is a timing chart schematically illustrating an example of the operation patterns of the pumps.

FIG. 5 is a timing chart schematically illustrating an example of the operation patterns of the pumps.

In the operation of the control device 50 as illustrated in FIG. 4, first, the calculation timing is set. The calculation timing is the calculation interval of the control device 50. The operation pattern command for each of the pumps 40 changes every calculation interval. Basically, a constant time interval is set.

Subsequently, the data collector 51 acquires the common pipe pressure information 61 from the pressure gauge 30 mounted in the common pipe 28 and collects the rolling material position information 62 and the rolling material property information 63 from the rolling control system 60.

The position of the rolling material 2*a* is known from the rolling material position information 62. For example, the pressure calculator 52 determines that the rolling material 2*a* has passed through the acceleration point of the pump 40 based on the rolling material position information 62 and controls the acceleration timing of the pump 40. In other words, the pressure calculator 52 determines the spray timing of each of the descaling headers 22*a*, 24*a*, and 26*a* to 26*d* based on the rolling material position information 62. Then, the pressure calculator 52 calculates the common pipe pressure to satisfy the desired scale removal performance from the common pipe pressure information 61, the rolling material property information 63, and the spray timing recited above. For example, the pressure of the common pipe 28 is changed according to the number, type, etc., of the descaling headers spraying simultaneously.

The pump controller 53 calculates the operation patterns of the multiple pumps 40 that can maintain the pressure of the common pipe 28 calculated by the pressure calculator 52.

As illustrated in FIG. 5, the operation patterns are the combination of the number of the pumps 40 of the multiple pumps 40 operating in the high-speed operation (100% speed) and the number of the pumps 40 of the multiple pumps 40 operating in the standby operation. The rotational speed of the pump 40 in the standby operation is, for example, about 50%. For example, it is also possible for the end user to determine the rotational speed of the standby operation.

The pump controller 53 transmits the calculated operation patterns to the drive devices 42 as the operation commands of the pumps 40 and realizes the operation pattern of each of the pumps 40 by controlling the acceleration and deceleration of each of the electric motors 41.

Also, the pump controller 53 inputs the calculated operation patterns to the protector 54. The protector 54 calculates the operation amount of each of the valves 45 from the operation pattern command and controls the opening/closing of each of the valves 45. When the pump 40 is set to the high-speed operation, the protector 54 closes the valve 45 corresponding to the pump 40 and feeds the high pressure water supplied from the pump 40 to each of the descaling headers 22*a*, 24*a*, and 26*a* to 26*d*. On the other hand, when the pump 40 is set to the standby operation, the protector 54 opens the valve 45 corresponding to the pump 40 and releases the high pressure water supplied from the pump 40 into the pit 48.

Thus, in the descaling system 20 according to the embodiment, the acceleration and deceleration of the pumps 40 are controlled according to the operation patterns calculated by the pump controller 53. Thereby, higher energy conservation can be realized while maintaining the scale removal performance for each of the materials. Also, in the descaling system 20, the opening/closing of each of the valves 45 is controlled according to the operation pattern. Thereby, the shutoff operation state of the pumps 40 can be suppressed. For example, the undesirable shortening of the equipment life can be suppressed for the pumps 40, the connection pipes 43, the branch pipes 44, etc.

Although an example is illustrated in the embodiment in which all of the pumps 40 of the multiple pumps 40 have variable speed operation, only one of n pumps may have variable speed operation; or up to n−1 pumps may have variable speed operation.

According to the embodiments, a descaling system, a control device of the descaling system, and a method for controlling the descaling system are provided, in which higher energy conservation is realized and the descaling system has a long life while maintaining the scale removal performance of the descaling system for each of the materials.

Hereinabove, embodiments of the invention are described with reference to specific examples. However, the embodiments of the invention are not limited to these specific examples. For example, one skilled in the art may similarly practice the invention by appropriately selecting specific configurations of components included in descaling systems such as descaling headers, common pipes, connection pipes, pumps, drive devices, branch pipes, valves, control devices, data collectors, pressure calculators, pump controllers, and protectors etc., from known art; and such practice is included in the scope of the invention to the extent that similar effects are obtained.

Further, any two or more components of the specific examples may be combined within the extent of technical feasibility and are included in the scope of the invention to the extent that the purport of the invention is included.

Moreover, all descaling systems, control devices of the descaling system, and methods for controlling the descaling system practicable by an appropriate design modification by one skilled in the art based on the descaling systems, the control devices of the descaling system, and the methods for controlling the descaling system described above as embodiments of the invention also are within the scope of the invention to the extent that the spirit of the invention is included.

Various other variations and modifications can be conceived by those skilled in the art within the spirit of the invention, and it is understood that such variations and modifications are also encompassed within the scope of the invention.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the invention.

The invention claimed is:

1. A descaling system, comprising:

a plurality of descaling headers provided in a rolling line;

a common pipe connected to each of the plurality of descaling headers;

a connection pipe connected to the common pipe;

a pump connected to the connection pipe, the pump supplying high pressure water to each of the plurality of descaling headers via the connection pipe and the common pipe;

a drive device controlling driving of the pump;

a branch pipe connected to the connection pipe;

a valve provided in the branch pipe, the valve controlling an opening/closing of the branch pipe; and a control device including a data collector collecting common pipe pressure information, rolling material position information, and rolling material property information, the common pipe pressure information indicating a pressure inside the common pipe, the rolling material position information indicating a position on the rolling line of a rolling material, the rolling material property information indicating a material property of the rolling material, a pressure calculator calculating the pressure inside the common pipe to satisfy a desired scale removal performance for the rolling material, the calculating being based on the common pipe pressure information, the rolling material position information, and the rolling material property information, a pump controller calculating an operation pattern of the pump to maintain the calculated pressure inside the common pipe, the pump controller inputting the operation pattern to the drive device, and a protector calculating an operation amount of the valve based on the operation pattern and controlling an opening/closing of the valve according to the operation amount, wherein the pressure calculator is configured to designate spray patterns of the high pressure water for the descaling headers based on the rolling material property information, designate the position of the rolling material based on the rolling material position information, predict a spray timing of each of the descaling headers from the position of the rolling material and the spray patterns, and calculate the pressure inside the common pipe from the predicted spray timing.

2. The descaling system according to claim 1, wherein the connection pipe, the pump, the drive device, the branch pipe, and the valve each are multiply provided, the plurality of connection pipes is connected in parallel with the common pipe, the plurality of pumps is connected respectively to the plurality of connection pipes, the plurality of drive devices respectively controls the driving of the plurality of pumps, the plurality of branch pipes is connected respectively to the plurality of connection pipes, the plurality of valves is provided respectively in the plurality of branch pipes and respectively controls the opening/closing of the plurality of branch pipes, the pump controller calculates a plurality of the operation patterns corresponding respectively to the plurality of pumps, and the protector calculates a plurality of the operation amounts corresponding respectively to the plurality of valves based on the plurality of operation patterns and respectively controls the opening/closing of the plurality of valves according to the plurality of operation amounts.

3. The descaling system according to claim 2, wherein the pump controller respectively inputs the plurality of operation patterns to the plurality of drive devices.

4. The descaling system according to claim 1, wherein the operation pattern indicates a timing of setting the pump to a high-speed operation and a timing of setting the pump to a standby operation, and the protector calculates the operation amount to close the valve when the pump is set to the high-speed operation, and to open the valve when the pump is set to the standby operation.

5. The descaling system according to claim 1, further comprising a pressure gauge measuring the pressure inside the common pipe, the data collector collecting the common pipe pressure information from the pressure gauge.

6. The descaling system according to claim 1, further comprising a check valve provided in a portion between the common pipe and the branch pipe of the connection pipe.

7. The descaling system according to claim 1, further comprising:

a pressure gauge configured to measure a pressure inside the connection pipe, wherein the valve is configured to open and release the high pressure water into the branch pipe when the pressure gauge measures the pressure not less than a constant value.

8. A control device of a descaling system, the descaling system comprising a plurality of descaling headers provided in a rolling line; a common pipe connected to each of the plurality of descaling headers; a connection pipe connected to the common pipe; a pump connected to the connection pipe, the pump supplying high pressure water to each of the plurality of descaling headers via the connection pipe and the common pipe; a drive device controlling driving of the pump; a branch pipe connected to the connection pipe; and a valve provided in the branch pipe, the valve controlling an opening/closing of the branch pipe, the control device of the descaling system comprising:

a data collector collecting common pipe pressure information, rolling material position information, and rolling material property information, the common pipe pressure information indicating a pressure inside the common pipe, the rolling material position information indicating a position on the rolling line of a rolling material, the rolling material property information indicating a material property of the rolling material;

a pressure calculator calculating the pressure inside the common pipe to satisfy a desired scale removal performance for the rolling material, the calculating being based on the common pipe pressure information, the rolling material position information, and the rolling material property information;

a pump controller calculating an operation pattern of the pump to maintain the calculated pressure inside the common pipe, the pump controller inputting the operation pattern to the drive device; and a protector calculating an operation amount of the valve based on the operation pattern and controlling an opening/closing of the valve according to the operation amount, wherein the pressure calculator is configured to designate spray patterns of the high pressure water for the descaling headers based on the rolling material property information, designate the position of the rolling material based on the rolling material position information, predict a spray timing of each of the descaling headers from the position of the rolling material and the spray patterns, and calculate the pressure inside the common pipe from the predicted spray timing.

9. A method for controlling a descaling system, the descaling system comprising a plurality of descaling headers provided in a rolling line; a common pipe connected to each of the plurality of descaling headers; a connection pipe connected to the common pipe; a pump connected to the connection pipe, the pump supplying high pressure water to each of the plurality of descaling headers via the connection pipe and the common pipe; a drive device controlling driving of the pump; a branch pipe connected to the connection pipe; and a valve provided in the branch pipe, the valve controlling an opening/closing of the branch pipe, the method for controlling the descaling system comprising:

collecting common pipe pressure information, rolling material position information, and rolling material property information, the common pipe pressure information indicating a pressure inside the common pipe, the rolling material position information indicating a position on the rolling line of a rolling material, the rolling material property information indicating a material property of the rolling material;

calculating the pressure inside the common pipe to satisfy a desired scale removal performance for the rolling material, the calculating being based on the common pipe pressure information, the rolling material position information, and the rolling material property information;

calculating an operation pattern of the pump to maintain the calculated pressure inside the common pipe, and inputting the operation pattern to the drive device; and calculating an operation amount of the valve based on the operation pattern and controlling an opening/closing of the valve according to the operation amount, wherein the step of calculating the pressure includes designating spray patterns of the high pressure water for the descaling headers based on the rolling material property information, designating the position of the rolling material based on the rolling material position information, predicting a spray timing of each of the descaling headers from the position of the rolling material and the spray patterns, and calculating the pressure inside the common pipe from the predicted spray timing.

* * * * *